United States Patent [19]

Gross

[11] 4,100,869

[45] Jul. 18, 1978

[54] EXPANDING CRIMP TOOL FOR VALVED DISPENSERS AND THE LIKE

[76] Inventor: Jerome A. Gross, 6304 S. Rosebury, St. Louis, Mo. 63105

[21] Appl. No.: 762,497

[22] Filed: Jan. 26, 1977

[51] Int. Cl.[2] ..... B21D 37/00

[52] U.S. Cl. ..... 113/18 R; 29/523; 113/30; 113/120 Y; 113/121 C

[58] Field of Search ..... 72/58, 61, 54, DIG. 14, 72/465; 113/30, 121 A, 121 AB, 120 Y, 1 N, 1 E, 18 R, 18 C, 18 E; 29/243.52, 243.58, 421 R, 523, 509

[56] References Cited

U.S. PATENT DOCUMENTS

| | | | |
|---|---|---|---|
| 1,941,195 | 12/1933 | Anderson | 113/30 UX |
| 2,254,577 | 9/1941 | Nelson | 113/30 |
| 2,644,415 | 7/1953 | Spalding | 113/18 R |
| 3,548,564 | 12/1970 | Bruce et al. | 113/120 Y X |
| 4,000,708 | 1/1977 | Hardt | 29/523 X |

FOREIGN PATENT DOCUMENTS

| | | |
|---|---|---|
| 535,726 | 4/1941 | United Kingdom. |

*Primary Examiner*—Leon Gilden

[57] ABSTRACT

In a tool for crimping a valve mounting cup into the mouth of a dispensing can, an annular piston which moves between inner and outer cylinders presses on the upper edge of a rubber sleeve whose inner and lower surfaces are restrained by the inner cylinder and an outward extending flange at its base. Since a downward force on the piston is resisted by the base flange, the axial length of the rubber-like sleeve is shortened, causing it to bulge radially outward beneath the lower edge of the outer cylinder. This outer cylinder is positioned on the mounting cup rim. The rubber sleeve, bulging outward beneath the rim, draws the inner wall of the mounting cup radially outward to seal it onto the can.

5 Claims, 4 Drawing Figures

EXPANDING CRIMP TOOL FOR VALVED DISPENSERS AND THE LIKE

BACKGROUND OF THE INVENTION

Prior art crimping tools for sealing valve mounting cups to the rimmed mouth dispensing cans, to applicant's best knowledge, utilize an assembly of collets which fit into the mounting cup. The collets are driven radially outward against the inner wall of the mounting cup, drawing the inner wall radially outward against and beneath the rimmed mouth of the can.

SUMMARY OF THE INVENTION

A principle object of the present invention is to provide a tool for crimping mounting cups to the rimmed mouths of dispensing cans without leaving gaps which may impair sealing, as do expanding collet crimping tools. Another object is to provide so even a seal as may in some cases eliminate the necessity for a rubber seal between the mouth rim and the underside of the mounting cup. Other objects will be apparent from this specification.

Briefly summarizing, the present crimping tool utilizes inner and outer cylindrical members secured together with a rubber sleeve in the annular space between them. The inner member has, along the vertical axis, a hollow which accommodates the dispensing valve, and a radially outward based flange. The outer member has a lower surface portion spaced upwardly from the base flange and adapted to fit the mounting cup rim. The rubber sleeve rests upon the base flange. An annular piston whose lower surface rests on the sleeve also fits between the inner and outer members.

The upper portion of the outer member is narrowed; it has parallel vertical sides terminating at a horizontal shoulder, above which opposite portions of the upper surface of the piston is exposed. A lever is utilized to apply a downward force on these exposed piston surface portions. Above this level, the inner and outer members are secured together by a detent pin.

In crimping a mounting cup to the mouth of a can, the mounting cup convex rim is placed on the can mouth, with the base flange of the inner member resting on the bottom surface of the mounting cup. The tool is operated by using the lever to force the piston downward against the rubber sleeve. The base flange resists the downward force, and the inner surface of the outer member and outer surface of the inner member restrain the rubber from radial movement. However the sleeve is shortened axially bulging radially outward in the space above the base flange and below the lower surface portion of the outer member. The bulge is so positioned as to force the inner wall of the mounting cup radially outward beneath the rimmed mouth of the can.

The present invention also provides a new use for an expanding tool, namely, to crimp a valve mounting cup to the mouth of a dispensing can. Steps of the new process include placing a valve mounting cup onto the rimmed mouth of a can, positioning a rubber-like sleeve against the inner wall of the cup, pressing the upper edge of the sleeve downward while confining its lower edge, inner edge, and outer edge along its portion above the inner wall, and thus displacing the rubber radially outward along the inne wall, to crimp the inner wall of the mounting cup beneath the rimmed mouth of the dispensing can.

DESCRIPTION OF THE PREFERRED EMBODIMENT

Figure 2:
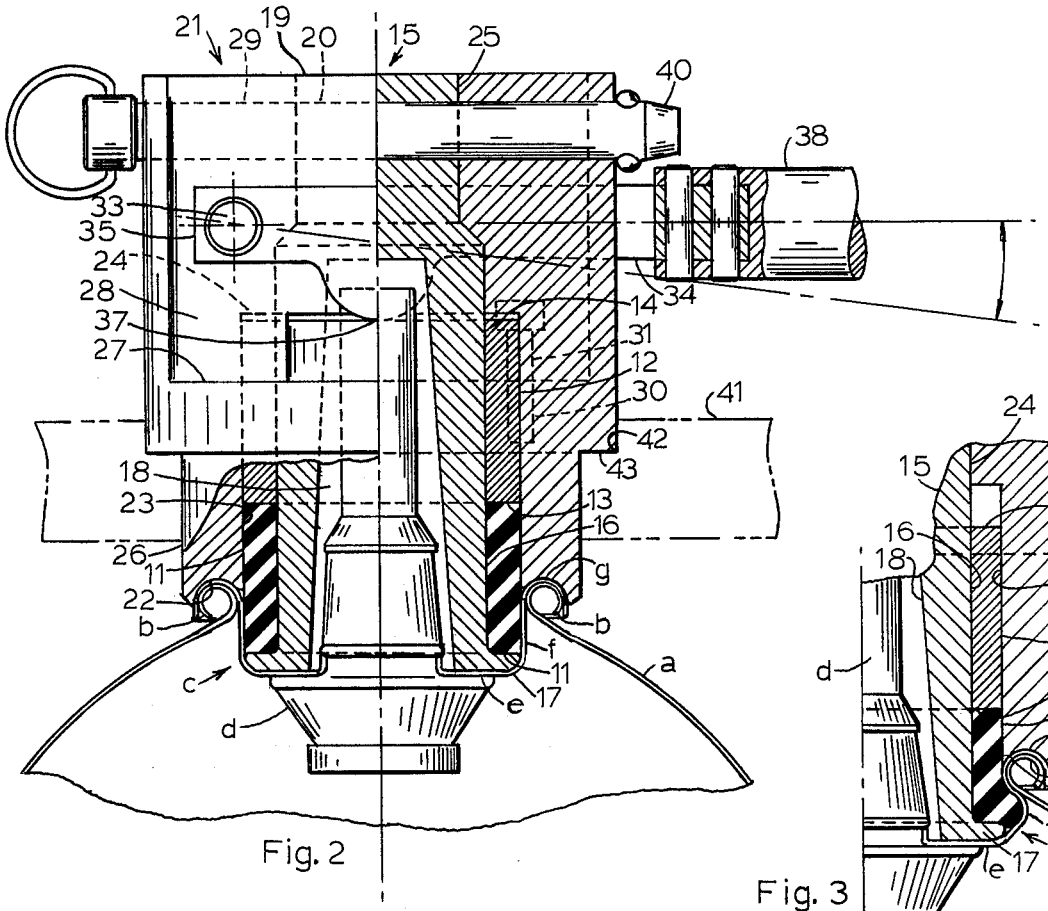
FIG. 2 is an elevation of the crimp tool of FIG. 1, with its inner and outer members partially cut away. The tool is shown in position on the mounting cup of a dispensing can prior to crimping.

The drawings show a preferred embodiment of the expanding crimp tool for valved dispensing cans of the type commonly employing aerosol propellants. A conventional aerosol dispensing can, generally designated *a*, has as seen in FIG. 2 a mouth *b* to which is to be mounted a valve mounting cup, generally designated *c*. The valve mounting cup *c* has a dispensing valve *d* mounted through a lower planar cup portion *e*. This portion *e* extends to an originally vertical inner wall *f* which extends upward to a convex rim *g*.

The outward-expanding member of the crimping tool, generally designated 10 is an elastic rubber-like sleeve 11 which when relaxed has the hollow cylindrical configuration shown in FIG. 2. On it rests an annular piston 12, preferably steel, having lower and upper piston surfaces 13, 14. The sleeve 11 and piston 12 are centered on the tool vertical axis by an inner member, generally designated 15, which has an outer cylindrical restraining surface 16 extending upward from a radially outward base flange 17. The axial length of the outer restraining surface 16 is greater than the combined axial lengths of the rubber-like sleeve 11 and the annular piston 12. Inward from the base flange 17 the inner member 15 has a central hollow 18 whose dimensions are sufficient to accept the dispensing valve *d*.

Above the piston 12 the outer surface of the inner member tapers to an upper cylindrical mounting portion 19 having a fore-and-aft bore 20.

The outer part of the crimping tool 10 is an outer member, generally designated 21, having an annular inverted concave lower surface portion forming a lip 22 which fits onto the convex rim *g* of the valve mounting cup *c* as seen in FIG. 2. The outer member 21 has a cylindrical inner restraining surface 23 extending upwardly from the lower surface portion 22 to an inner shoulder 24 extending radially inward. The axial length of the inner restraining surface 23 is less than the axial length of the outer cylindrical restraining surface 16 of the inner member 15. Above the inner shoulder 24, the inner surface of the outer member 22 terminates in an inner cylindrical surface 25 formed to accept the upper part of the inner member 15. This upper portion of the outer member 21 has a fore-and-aft bore 29 aligned with the inner member fore-and-aft bore 20.

Similar to the rubber-like sleeve 11, the annular piston 12 fits slideably between the opposed retraining surfaces 16, 23 of the inner and outer members 15, 21. When these members 15, 21 are fitted together, the lip 22 of the outer member 21 is spaced upwardly from the base flange 17 of the inner member 15 as seem in FIG. 2; thus the lower portion of the outer surface of the rubber-like sleeve 11 is its only unrestrained surface.

The outer configuration of the outer member 21 will now be described. A cylindrical outer surface 26 extends upwardly to inward-extending shoulders 27 at a level below the upper edge of the annular piston. These shoulders 27 extend inward to two vertical planar upper side surfaces 28 which describe parallel chords equidistant from the vertical axis of the crimping tool 10. These planar side surfaces 28 are spaced sufficiently inward to expose diametrically opposite portions of the upper surface 14 of the annular piston 12. A detent pin 40 through the fore-and-aft bores 20, 29 secures the members 15, 21 together and functions as a shear pin. Threaded bores 30, downward into the inward-extending shoulders 27 and aft of the exposed surface portions of the upper piston surface 14, accept stud bolts 31 which serve as adjustable stops, as described below.

Figure 1:
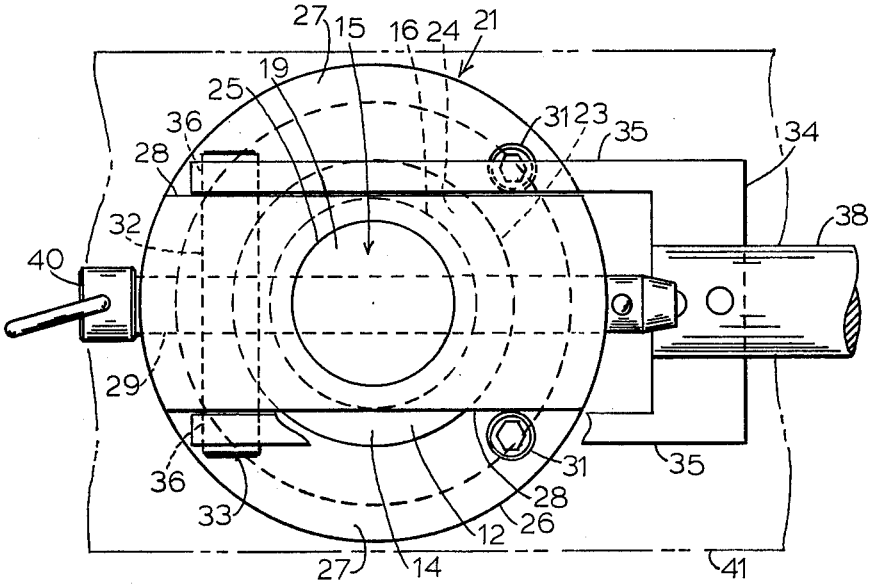
FIG. 1 is a plan view of a preferred embodiment of an expanding crimp tool embodying the present invention.

Transversely through the left side of the upper part of the outer member 21 as seen in FIG. 2 and perpendicular to its parallel side surfaces 28 is a fulcrum bore 32, into which is fitted a fulcrum pin 33. As shown in FIG. 1, a yoke-like lever 34 has two yoke members 35, one outward of each of the side surfaces 28; both are mounted to the fulcrum pin 33 by bores 36 adjacent to their ends. Downward projecting lugs 37 which form portions of the lower surfaces of the yoke members 35 bear downward on the exposed portions of the upper surface 14 of the annular piston 12. The yoke-like lever 34 has an actuating part 38 at the juncture of the yoke members 35 and extending to the right therefrom.

Figure 3:
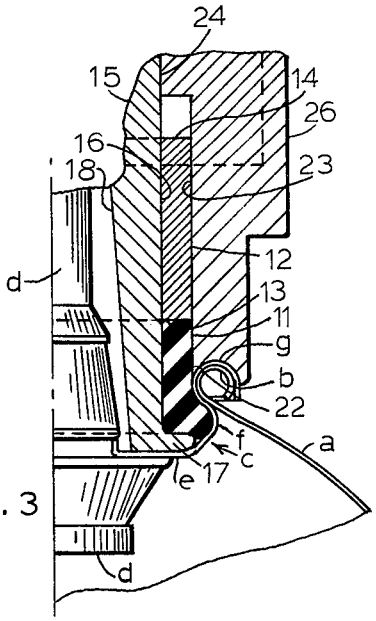
FIG. 3 is a partial sectional view similar to FIG. 2, showing the position of the parts as the rubber sleeve sulges and draws the mounting cup wall outward.
Figure 4:
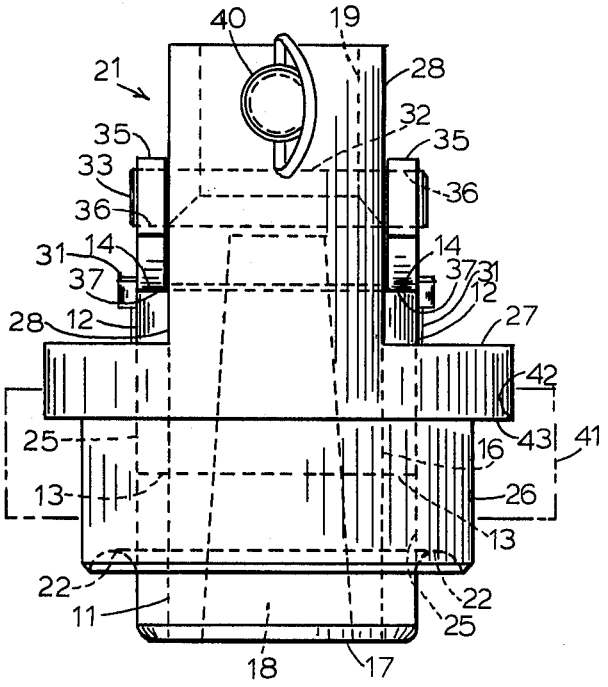
FIG. 4 is an elevation of the crimp tool as seen from the left end of FIGS. 1 and 2.

Prior to operating the crimping tool 10, the valve mounting cup *c* is placed onto the mouth *b* of the dispensing can *a*. The crimping tool 10 is then lowered by conventional means, such as a support frame 41 shown schematically. Such frame 41 may have a bored and counterbored seat 42 in which fits a downward-presented shoulder 43 of the outer member 21. When so lowered, the base flange 17 fits into the mounting cup *c*, and against its surface *e*, with the lip 22 of the outer member 21 upon the mounting cup rim *g* and the unrestrained outer surface portion of the rubber-like sleeve 11 adjacent to the inner wall *f*. Downward movement of the actuating part 38 of the lever 34 forces the annular piston 12 downward. Its downward force is resisted by the base flange 17, shortening the axial length of the rubber-like sleeve 11, causing the sleeve 11 to bulge outwardly radially between the base flange 17 and the lip 22 of the outer member 21. This bulging draws the inner wall *f* of the mounting cup *c* radially outward beneath the mouth *b* of the dispensing can *a*, as shown in FIG. 3. Return of the lever 34 to a normal position permits the rubber-like sleeve 11 to spring back to its normal shape, so that the crimping tool 10 may be removed upwardly from the mounting cup *c*.

The present invention includes the process of using the expanding tool 10 to expand the originally vertical inner wall *f* of the valve mounting cup *c* into the mouth *b*, of a dispensing can *a*. A valve mounting cup *c* is placed onto the rimmed mouth *b* of a can *a* and the rubber-like sleeve 11 is positioned inside the mounting cup *c* and against its inner wall *f*. The sleeve 11 is confined along its lower edge, inner edge, and outer edge above the portion adjacent to the mounting cup inner wall *f*. The upper edge of the sleeve 11 is pressed downward, shortening its axial length. This causes the sleeve to be displaced radially outward along the inner wall of the mounting cup *c*, thus crimping it to the rimmed mouth *b* of the dispensing can *a*.

This description of the preferred embodiment is not intended to limit the scope of the invention. Thus, the annular piston 12 could be forced downward by other types of actuating means, such as a hydraulic system. The sleeve 11 may be constructed of any material which flows almost fluid-like under pressure, as one whose Poisson's ratio approaches one and whose modulus of elasticity is low. Other modifications will, from this disclosure, be apparent to persons skilled in the art.

I claim:

1. For crimping into the mouth of a dispensing can a valve mounting cup of the type having a convex rim and an inner wall extending downward therefrom to a valve-mounting surface, a crimping tool, comprising an outer member having a vertical axis and having a lower surface portion adapted to fit onto such convex rim and having a cylindrical inner restraining surface, an inner member secured thereto in fixed position and having an outer cylindrical restraining surface spaced radially inward from said inner surface of the outer member and extending axially downward a fixed distance beyond its said lower surface portion and terminating in a radially outward base flange, a rubber-like sleeve positioned on said flange and extending upward therefrom beyond said lower surface portion of said outer member into the said space between the said spaced restraining surfaces, annular piston means fitted between said restraining surfaces in said space and having a lower edge upon said rubber-like sleeve, and means to force said piston means downward against the upper edge of said rubber-like sleeve, whereby, as it is compressed downward between said cylindrical restraining surfaces said rubber-like sleeve is shortened axially and bulges radially outward in the fixed space between the said base flange and the lower surface portion of the outer member, thereby to draw the inner wall of such mounting cup radially outward over that part of its area whose depth corresponds to the said fixed distance.

2. The invention as defined in claim 1, wherein said inner member has along its axis a hollow extending upward from its base flange, whereby to accommodate a valve mounted onto such mounting cup.

3. The invention as defined in claim 1, wherein the outer surface of said outer member has inward-extending shoulders at a level below the upper edge of said annular piston means extending inward to two vertical planar upper side surfaces which describe parallel chords equidistant from said vertical axis, their inward extent being sufficient to expose diametrically opposite portions of the upper edge of said annular piston means, and wherein the inward surface of said outer member has an inner shoulder extending radially inward above the upper end of said annular piston means, whereby to receive within it an upper portion of said inner member, and wherein the means to force said piston means downward bears on said exposed portions of the upper edge of said piston means.

4. The invention as defined in claim 3, wherein said means to force said piston downward comprises fulcrum means in said outer member transverse to said two vertical planar surfaces, displaced from the axis at a level above the upper edge of said piston means, a yoke-like lever having a yoke member outward of each said vertical planar surface and mounted to said fulcrum means, said members having lower surface portions bearing down on said exposed portions of the upper edge of said piston means, said yoke-like lever further having an actuating portion, whereby its downward movement forces said piston means downward.

5. The invention as defined in claim 3, wherein said inner and outer members have a common fore-and-aft bore through their portions above said inner shoulder of the inner surface of said outer member, together with a pin through said common bore, whereby said pin functions as a shear pin and whereby removal of said pin permits disassembly of the crimping tool to replace said rubber-like sleeve.

* * * * *